US012674376B2

(12) United States Patent
Kalb et al.

(10) Patent No.: US 12,674,376 B2
(45) Date of Patent: Jul. 7, 2026

(54) LINER HANGER WITH HYDRAULIC ACTUATOR LOCK

(71) Applicant: WEATHERFORD TECHNOLOGY HOLDINGS, LLC, Houston, TX (US)

(72) Inventors: Frank D. Kalb, Cypress, TX (US); Mark J. Murray, Sugarland, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 98 days.

(21) Appl. No.: 18/632,707

(22) Filed: Apr. 11, 2024

(65) Prior Publication Data

US 2025/0314155 A1 Oct. 9, 2025

Related U.S. Application Data

(60) Provisional application No. 63/631,834, filed on Apr. 9, 2024.

(51) Int. Cl.
*E21B 43/10* (2006.01)

(52) U.S. Cl.
CPC ..... *E21B 43/10* (2013.01)

(58) Field of Classification Search
CPC ..... E21B 43/10
See application file for complete search history.

(56) References Cited

U.S. PATENT DOCUMENTS 4,583,593 A 4/1986 Zunkel et al.
4,624,311 A 11/1986 Goad
6,241,018 B1 6/2001 Eriksen
7,114,573 B2 10/2006 Hirth et al.
9,187,994 B2 11/2015 Themig
10,094,197 B2 10/2018 Ward et al.
10,301,888 B2 5/2019 Richards et al.
11,028,653 B2 6/2021 El et al.
11,434,710 B2 9/2022 Goad, Jr. et al.
11,578,560 B2 2/2023 Zavala et al.
2004/0194954 A1* 10/2004 Cram ..... E21B 23/0411 166/212
2010/0038096 A1* 2/2010 Reimert ..... E21B 23/01 166/208

(Continued)

OTHER PUBLICATIONS

International Search Report with Written Opinion issued Jun. 3, 2025 for PCT Patent Application No. PCT/IB2025/052425, 14 pages.

*Primary Examiner* — George S Gray
(74) *Attorney, Agent, or Firm* — SMITH IP SERVICES, P.C.

(57) ABSTRACT

A liner hanger can include slips, a mandrel, an outer housing rigidly secured to the mandrel, a collet sleeve connected to the slips, and an annular piston in an annulus between the mandrel and the outer housing, the piston supporting the collets and thereby preventing displacement of the slips relative to the mandrel. Another liner hanger can include collets supported by an outer housing, and an annular piston supporting an engagement member and thereby preventing displacement of the slips relative to the mandrel. Another liner hanger can include a piston releasably secured to a mandrel, a collet sleeve secured against longitudinal displacement relative to the mandrel, and the piston including a support surface supporting an engagement member and thereby preventing displacement of slips relative to the mandrel.

7 Claims, 17 Drawing Sheets

(56) References Cited

U.S. PATENT DOCUMENTS

| | | | | |
|---|---|---|---|---|
| 2010/0155084 | A1 | 6/2010 | Watson et al. | |
| 2011/0209867 | A1 | 9/2011 | Nevels et al. | |
| 2012/0168178 | A1 | 7/2012 | Eriksen et al. | |
| 2013/0118758 | A1 | 5/2013 | Caminari | |
| 2015/0204144 | A1* | 7/2015 | Mullins | E21B 17/1078 166/208 |
| 2022/0025724 | A1* | 1/2022 | Goad, Jr. | E21B 23/04 |
| 2023/0033711 | A1 | 2/2023 | Kalb et al. | |
| 2023/0131175 | A1 | 4/2023 | Turley et al. | |

* cited by examiner

LINER HANGER WITH HYDRAULIC ACTUATOR LOCK

CROSS-REFERENCE TO RELATED APPLICATION

This application claims the benefit of the filing date of U.S. provisional application No. 63/631,834 filed on 9 Apr. 2024. The entire disclosure of the prior application is incorporated herein by this reference for all purposes.

BACKGROUND

This disclosure relates generally to equipment utilized and operations performed in conjunction with a subterranean well and, in examples described below, more particularly provides a liner hanger.

A liner is a protective lining used in a wellbore. A liner hanger is used to anchor the liner in a previously installed liner or casing.

Unfortunately, in some circumstances a liner hanger can be inadvertently set before it has been appropriately positioned in the previous liner or casing. Such an improperly set liner hanger can result in expensive and time-consuming operations to mitigate this problem.

It will, therefore, be appreciated that improvements are continually needed in the art of designing, constructing and operating liner hangers for use in subterranean wells. The present disclosure provides such improvements, which may be used in a variety of different types of well environments and well configurations.

DETAILED DESCRIPTION

Figure 1:
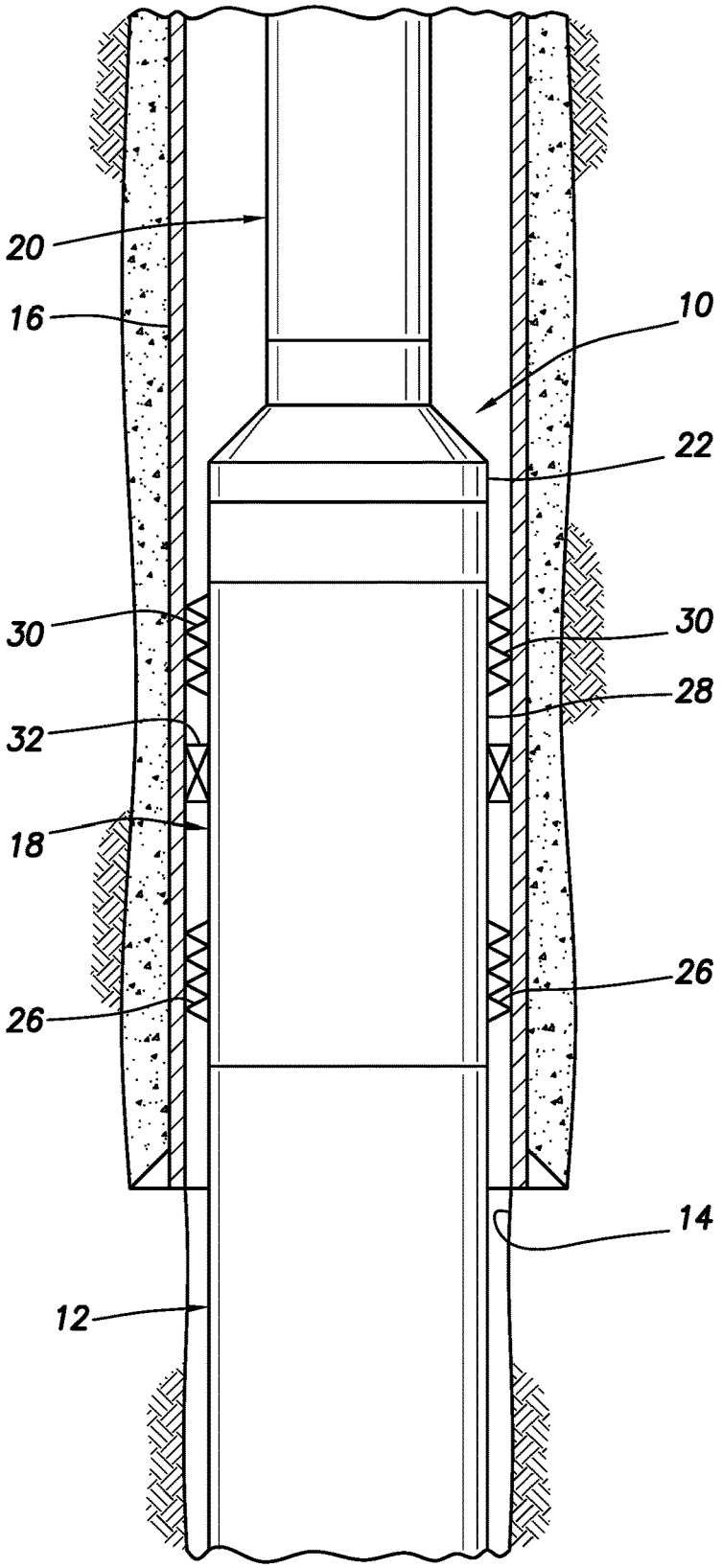
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIG. 1, a liner string 12 is installed in a wellbore 14 and is secured to a previously installed liner or casing 16 with a liner hanger 18. A work string 20 with a running tool 22 is used to convey the liner string 12 in the wellbore 14, and then to set the liner hanger 18 when it is appropriately positioned in the previous liner or casing 16.

In the FIG. 1 example, the liner hanger 18 is set by applying increased pressure in the work string 20 after deploying a ball, dart or other plug 24 (see FIG. 2B) into the work string. The applied pressure causes slips 26 to extend outward from the liner hanger 18 and grip an interior surface of the previous liner or casing 16. A packer section 28 of the liner hanger 18 includes additional slips 30 and an annular seal 32 that extend outwardly to grip the interior surface and seal against the interior surface, respectively, after the initial slips 26 are set.

It is important that the liner hanger 18 not be set until it is positioned at a desired location in the previous liner or casing 16. As described more fully below, the liner hanger 18 includes features that prevent it from being set until it is appropriately positioned in the previous liner or casing 16.

Figure 2A:
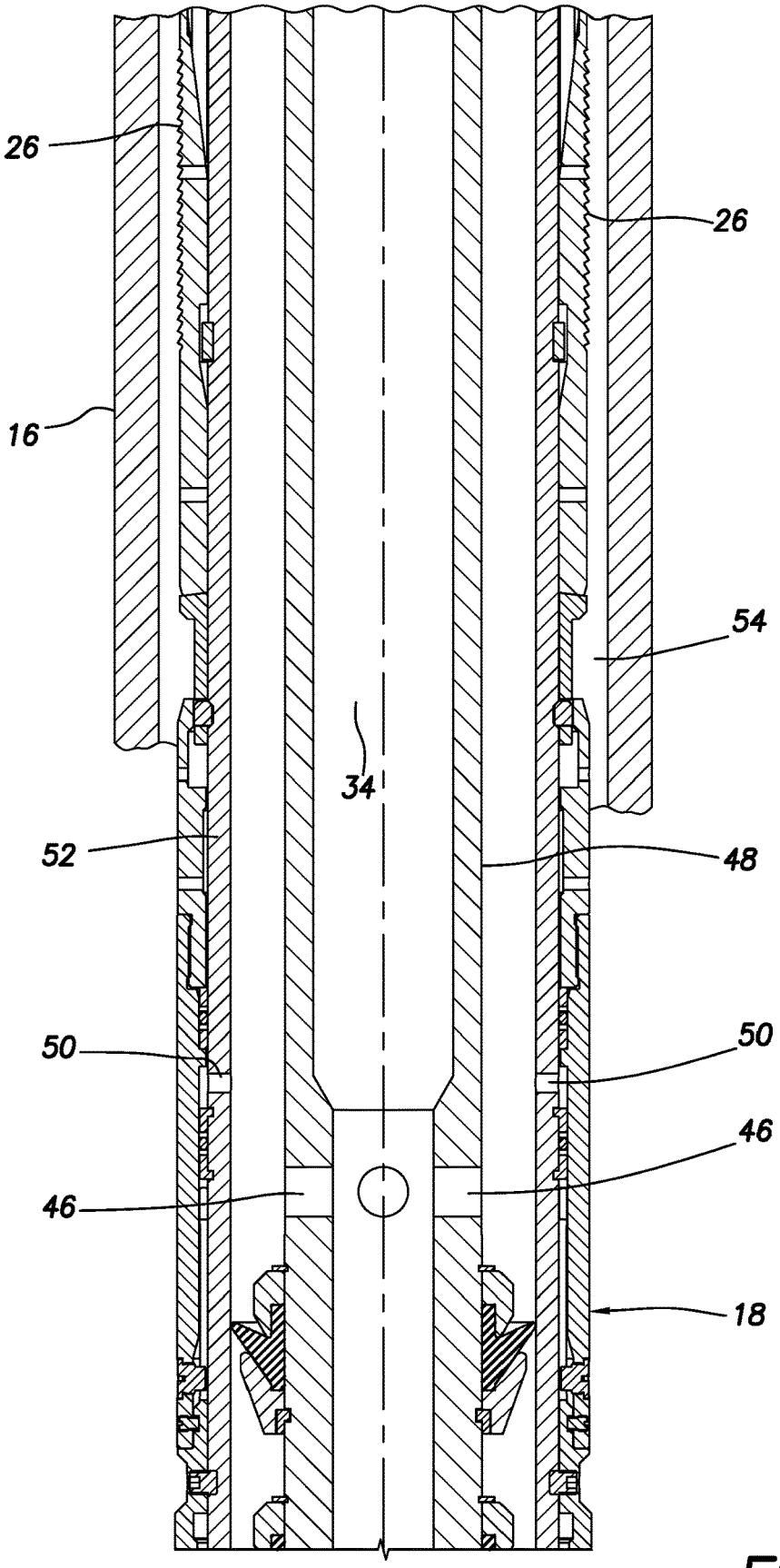
FIGS. 2A & B are representative cross-sectional views of an example of a liner hanger and a running tool as used in the well system and method.
Figure 2B:
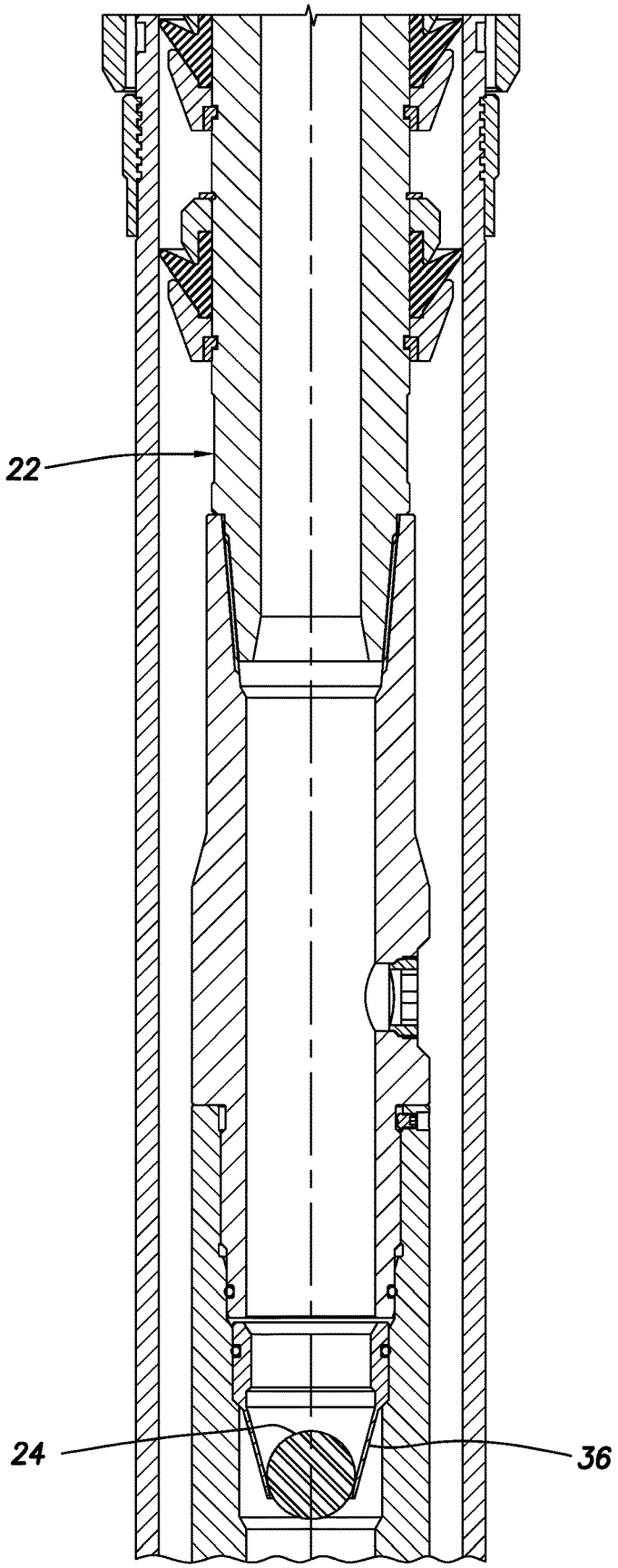

Referring additionally now to FIGS. 2A & B, more detailed cross-sectional views of a portion of examples of the liner hanger 18 and running tool 22 are representatively illustrated. The liner hanger 18 and running tool 22 may be used in the FIG. 1 system 10 and method, or they may be used in other systems and methods. For convenience, setting of the liner hanger 18 with the running tool 22 is described below as used with the FIG. 1 system 10 and method.

As depicted in FIGS. 2A & B, the liner hanger 18 has been positioned at a desired location in the previous liner or casing 16 for setting the liner hanger. The plug 24 has been deployed into a flow passage 34 extending through the running tool 22 and the work string 20 (see FIG. 1). As viewed in FIGS. 2A & B, the plug 24 has engaged an expandable seat 36 of the running tool 22.

Sufficient increased pressure applied to the flow passage 34 uphole of the plug 24 will cause the increased pressure to be applied to an interior of the liner hanger 18 via ports 46 formed in a tubular mandrel 48 of the running tool 22. The increased pressure enters at least one port 50 formed through an inner tubular mandrel 52 of the liner hanger 18.

The liner hanger 18 is set in response to the increased pressure applied via the port 50. More specifically, the liner hanger 18 is set in response to a predetermined pressure differential created between an interior of the liner hanger (communicated via the port 50) and an exterior of the liner hanger (such as, an annulus 54 formed radially between the liner hanger and the interior surface of the previous liner or casing 16).

Note that the FIGS. 2A & B running tool 22 is merely one example of a running tool that may be used to set the liner hanger 18. Other types of running tools (with or without an expandable seat) may be used in other examples. The scope of this disclosure is not limited to use of any particular type or configuration of running tool used to set the liner hanger 18.

Referring additionally now to FIGS. 3A-6, cross-sectional views of another example of the liner hanger 18 are representatively illustrated in a succession of stages of setting the liner hanger. The upper packer section 28 (see FIG. 1) and the running tool 22 (see FIGS. 1 and 2A & B) are not shown in FIGS. 3A-6 for clarity of illustration and description. Instead, only the setting of the initial set of slips 26 is described below, for an understanding of how inadvertent premature setting of the liner hanger 18 can be prevented using the principles of this disclosure.

Figure 3A:
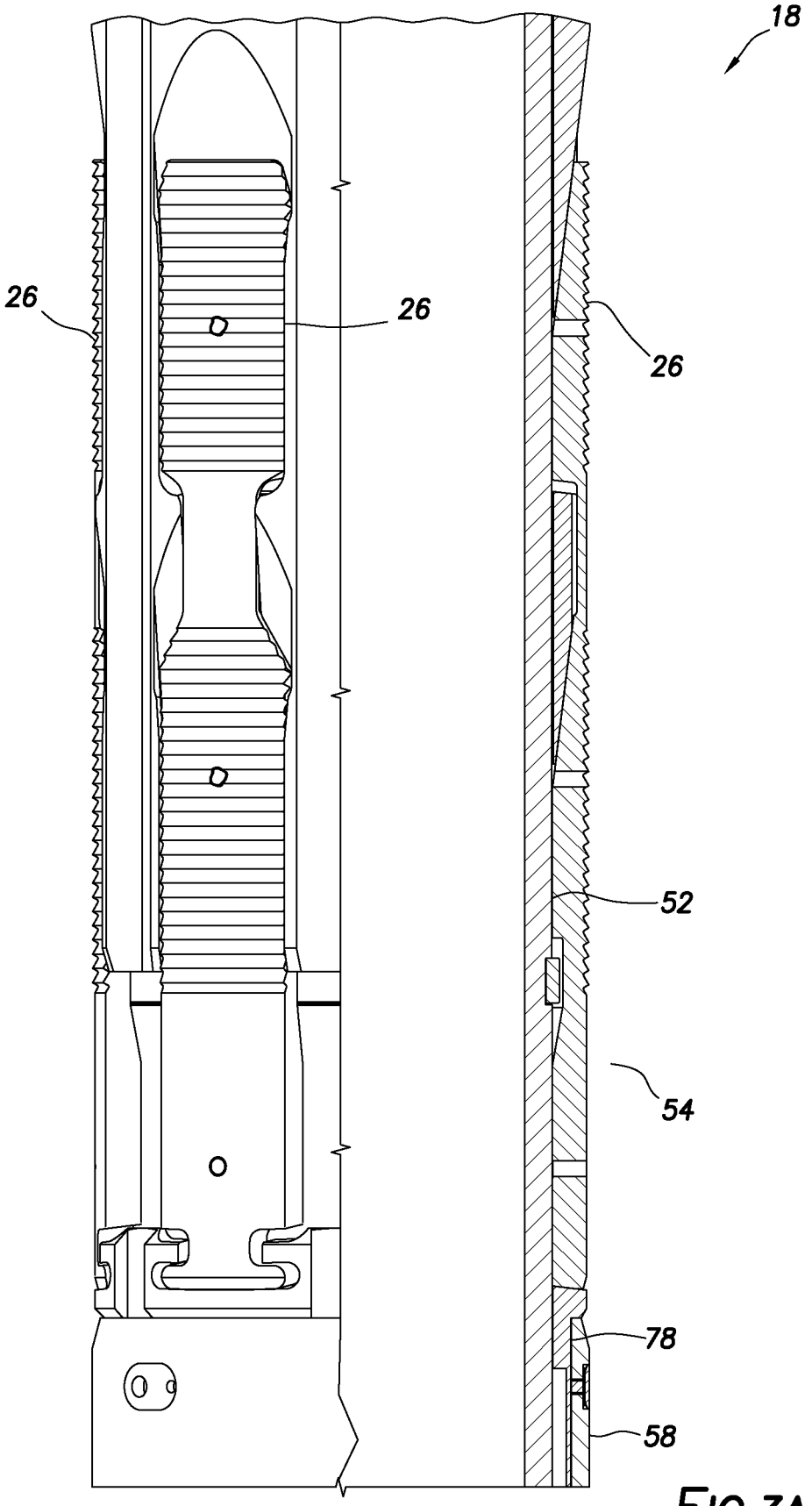
FIGS. 3A & B are representative partially cross-sectional views of another example of a liner hanger in a run-in configuration.
Figure 3B:
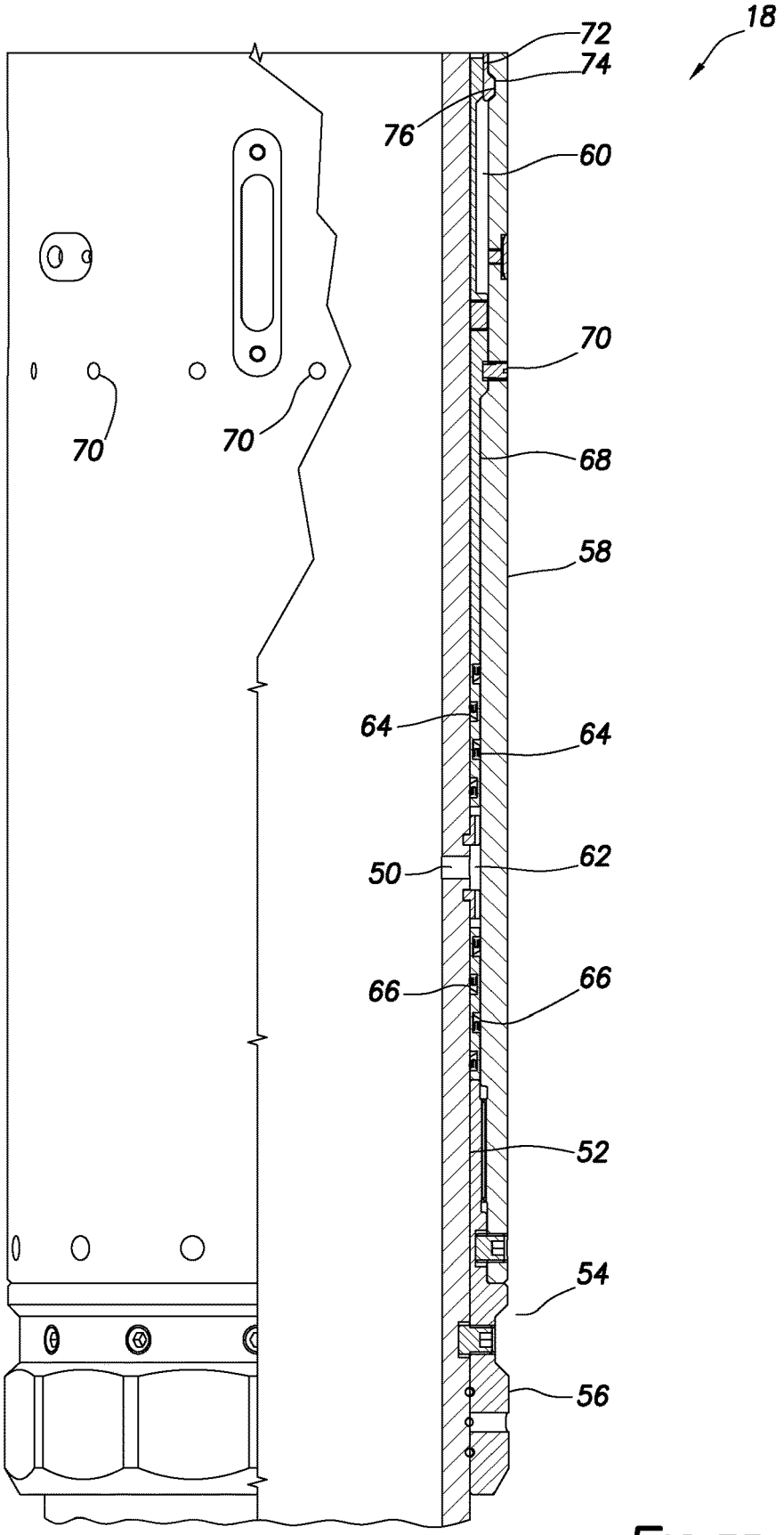

As depicted in FIGS. 3A & B, the liner hanger 18 is in a run-in configuration in which the liner hanger is conveyed into the previous liner or casing 16 (see FIGS. 1 and 2A & B). The slips 26 are in radially retracted positions in which they will not grip the previous liner or casing 16 (or any other structure surrounding the liner hanger 18). A gauge ring 56 secured to the mandrel 52 maintains radial spacing between the slips 26 and the previous liner or casing 16 as the liner hanger 18 is conveyed into a well.

A tubular outer housing 58 is secured to the gauge ring 56 and outwardly surrounds the mandrel 52, so that an annulus 60 is formed radially between the mandrel and the outer housing. The port 50 is in communication with a chamber 62 that comprises a portion of the annulus 60 isolated longitudinally between annular seals 64, 66.

An annular piston 68 is positioned in the annulus 60 uphole of the seal 64. The piston 68 is releasably secured against displacement relative to the outer housing 58 with shear members 70 (such as, a shear pin, shear screw, shear ring, etc.).

The piston 68 includes an exterior cylindrical support surface 72 formed thereon. The support surface 72 maintains multiple circumferentially distributed collets 74 radially outwardly engaged with a profile 76 formed in the outer housing 58.

The collets 74 are formed at a downhole end of a collet sleeve 78 positioned generally longitudinally between the piston 68 and the slips 26. The collet sleeve 78 is connected to downhole ends of the slips 26, so that the slips and the collet sleeve 78 displace with each other relative to the mandrel 52 when the liner hanger 18 is set as described more fully below.

When it is desired to set the liner hanger 18, increased pressure is applied to the chamber 62 via the port 50. The FIGS. 2A & B running tool 22 may be used for this purpose, although other running tools may be used in other examples.

Figure 4:
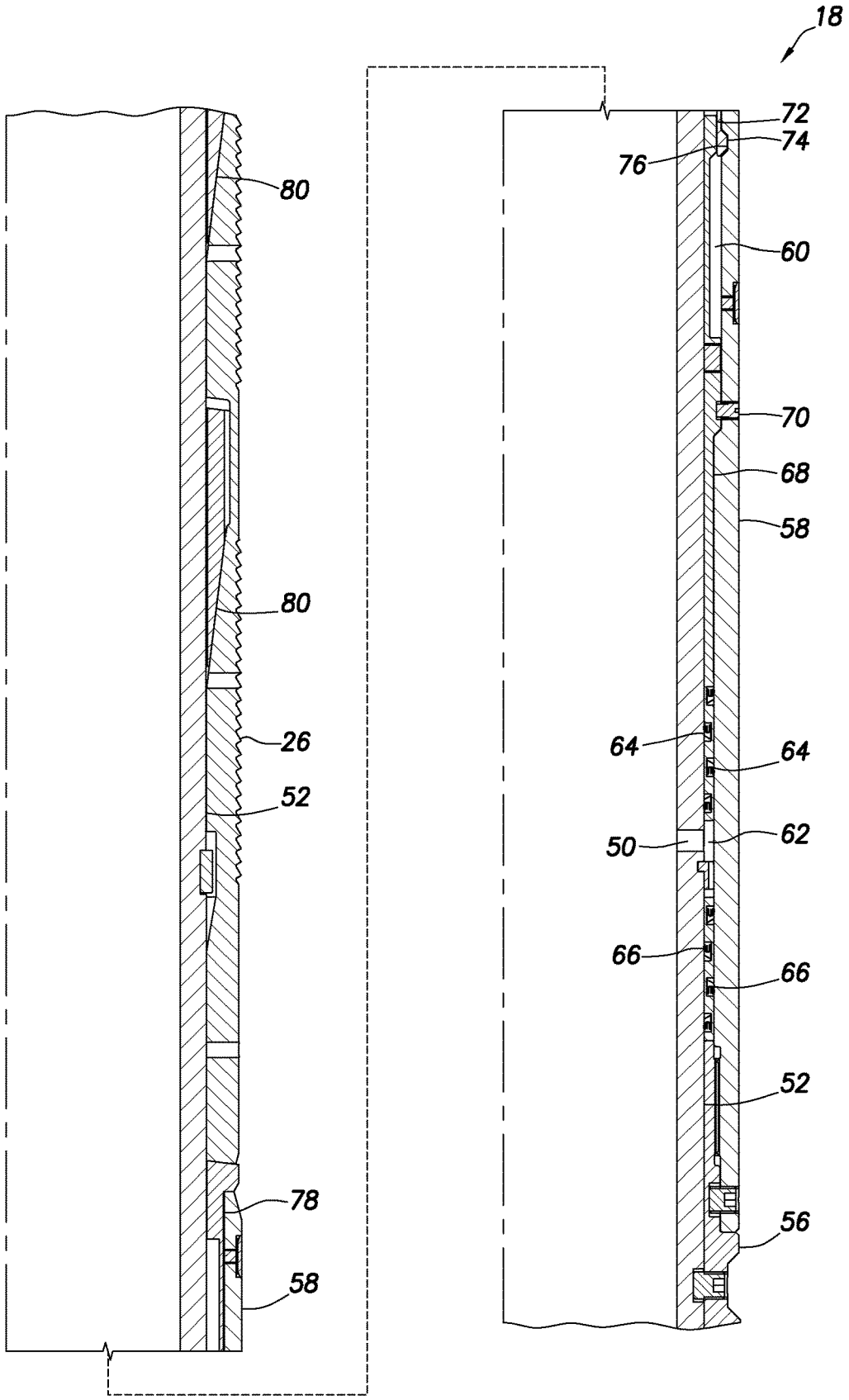
FIG. 4 is a representative cross-sectional view of the FIGS. 3A & B liner hanger in the run-in configuration.

Referring now to FIG. 4, the liner hanger 18 is representatively illustrated in the run-in configuration at a somewhat larger scale. In this view it may be more clearly seen that the slips 26 will be extended radially outward by conical wedges 80 if the slips are displaced uphole (upward as viewed in FIG. 4) relative to the mandrel 52.

Figure 5:
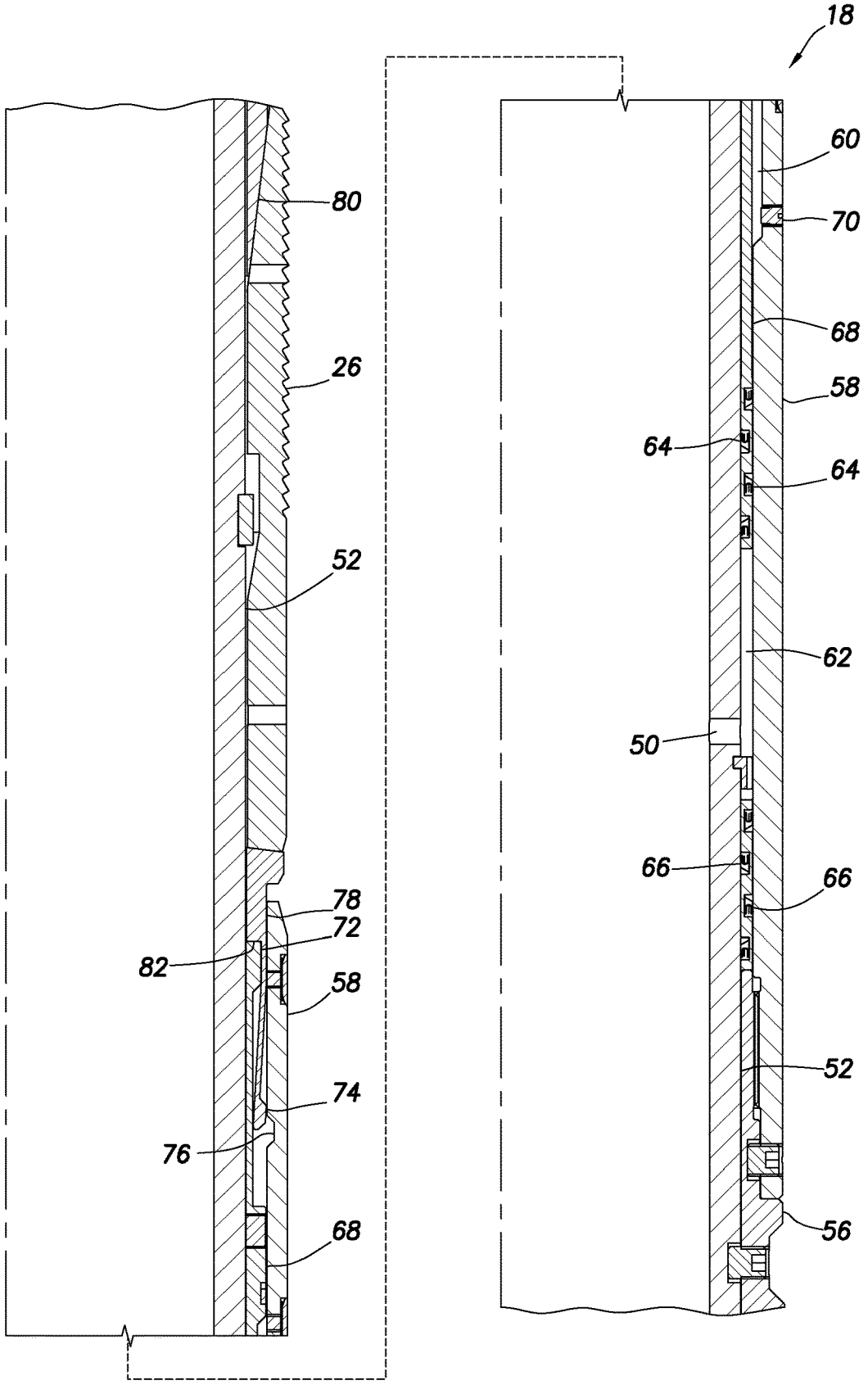
FIG. 5 is a representative cross-sectional view of the FIGS. 3A & B liner hanger in a partially set configuration.

Referring now to FIG. 5, the liner hanger 18 is representatively illustrated in a partially set configuration at a further enlarged scale. In this view, pressure applied via the port 50 has been sufficiently increased to cause the shear members 70 to shear, thereby allowing the piston 68 to displace uphole relative to the mandrel 52. Stated differently, a sufficient pressure differential has been applied from the interior to the exterior of the liner hanger 18 to shear the shear members 70 and displace the piston 68 upward.

The upward displacement of the piston 68 also displaces the support surface 72, so that it no longer outwardly supports the collets 74 in engagement with the profile 76. An upper end of the piston 68 now abuts an internal shoulder 82 in the collet sleeve 78 and thereby applies an upwardly biasing force to the collet sleeve.

The collets 74 are permitted to displace radially inward and out of engagement with the profile 76. As depicted in FIG. 5, the piston 68 has displaced the collet sleeve 78 and the slips 26 upward somewhat due to the pressure differential across the seals 64.

Figure 6:
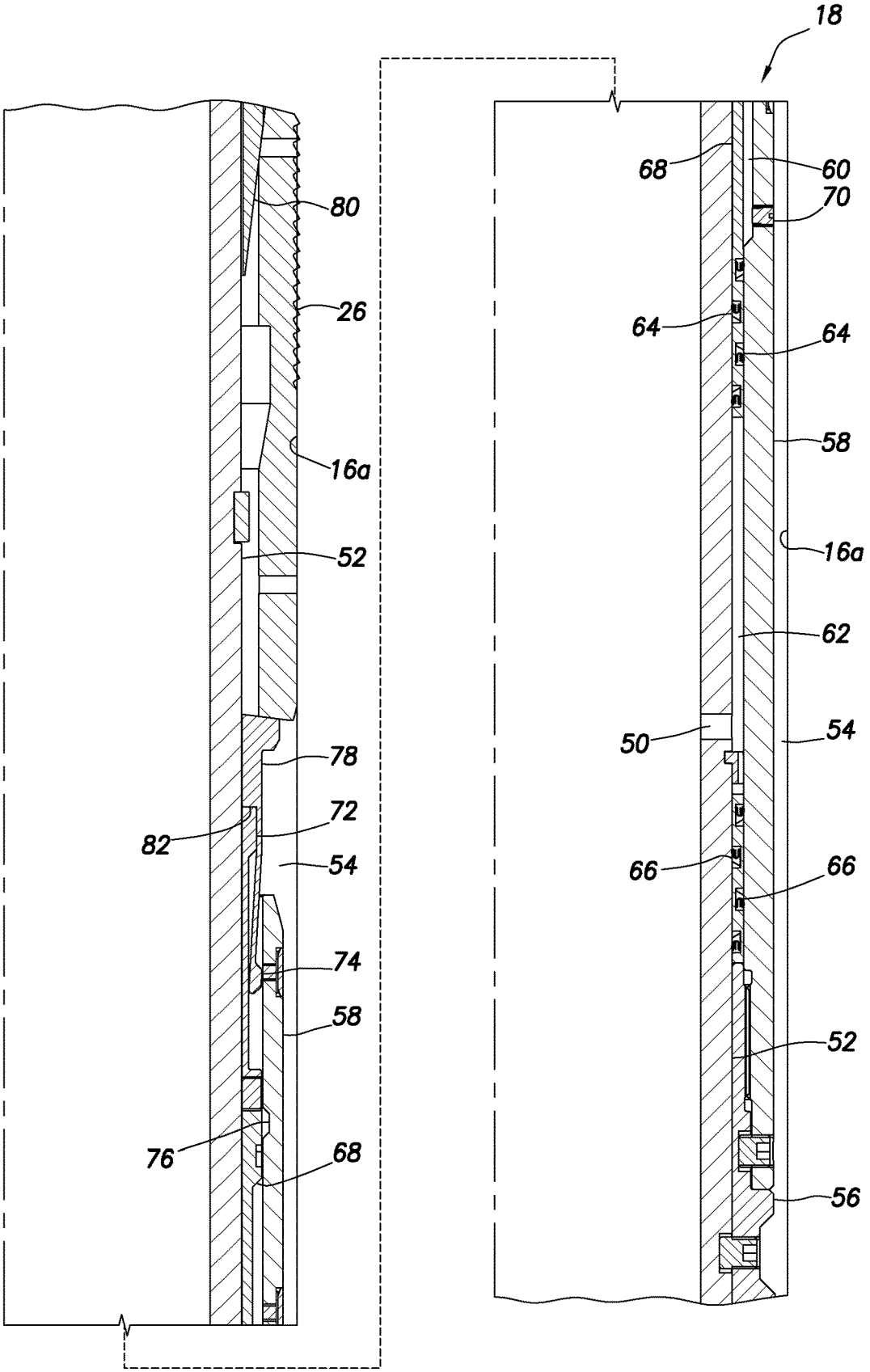
FIG. 6 is a representative cross-sectional view of the FIGS. 3A & B liner hanger in a set configuration.

Referring now to FIG. 6, the liner hanger 18 is representatively illustrated in a fully set configuration. In this configuration, the slips 26 have been displaced a sufficient distance upward relative to the mandrel 52, so that the wedges 80 have deflected the slips radially outward into gripping engagement with the interior surface 16*a* of the previous liner or casing 16.

It will be appreciated that the collet sleeve 78 and the slips 26 cannot be displaced upward to cause the slips to displace outward into engagement with the interior surface 16*a*, until the piston 68 has been displaced upward by the differential pressure across the piston. In addition, the piston 68 cannot be displaced upward by contact with any shoulders, restrictions, etc. in the previous liner or casing 16 as the liner hanger 18 is conveyed into the well, since the piston is protected against such contact in the annulus 60 between the mandrel 52 and the outer housing 58. Thus, the liner hanger 18 cannot be prematurely or inadvertently set.

Another beneficial feature of the FIGS. 3A-6 example of the liner hanger 18 is that the inward deflection of the collets 74 effectively "captures" the upper end of the piston 68, so that longitudinal displacement of the piston relative to the mandrel 52 and outer housing 58 is prevented when the liner hanger 18 is set. This lack of displacement of the piston 68 after setting of the liner hanger 18 helps to prevent any subsequent wear or other damage to the seals 64.

Referring additionally now to FIGS. 7A-10, another example of the liner hanger 18 is representatively illustrated. Elements of the FIGS. 7A-10 liner hanger 18 that are the same as or similar to elements of the FIGS. 3A-6 liner hanger are indicated in FIGS. 7A-10 using the same reference numbers.

Figure 7A:
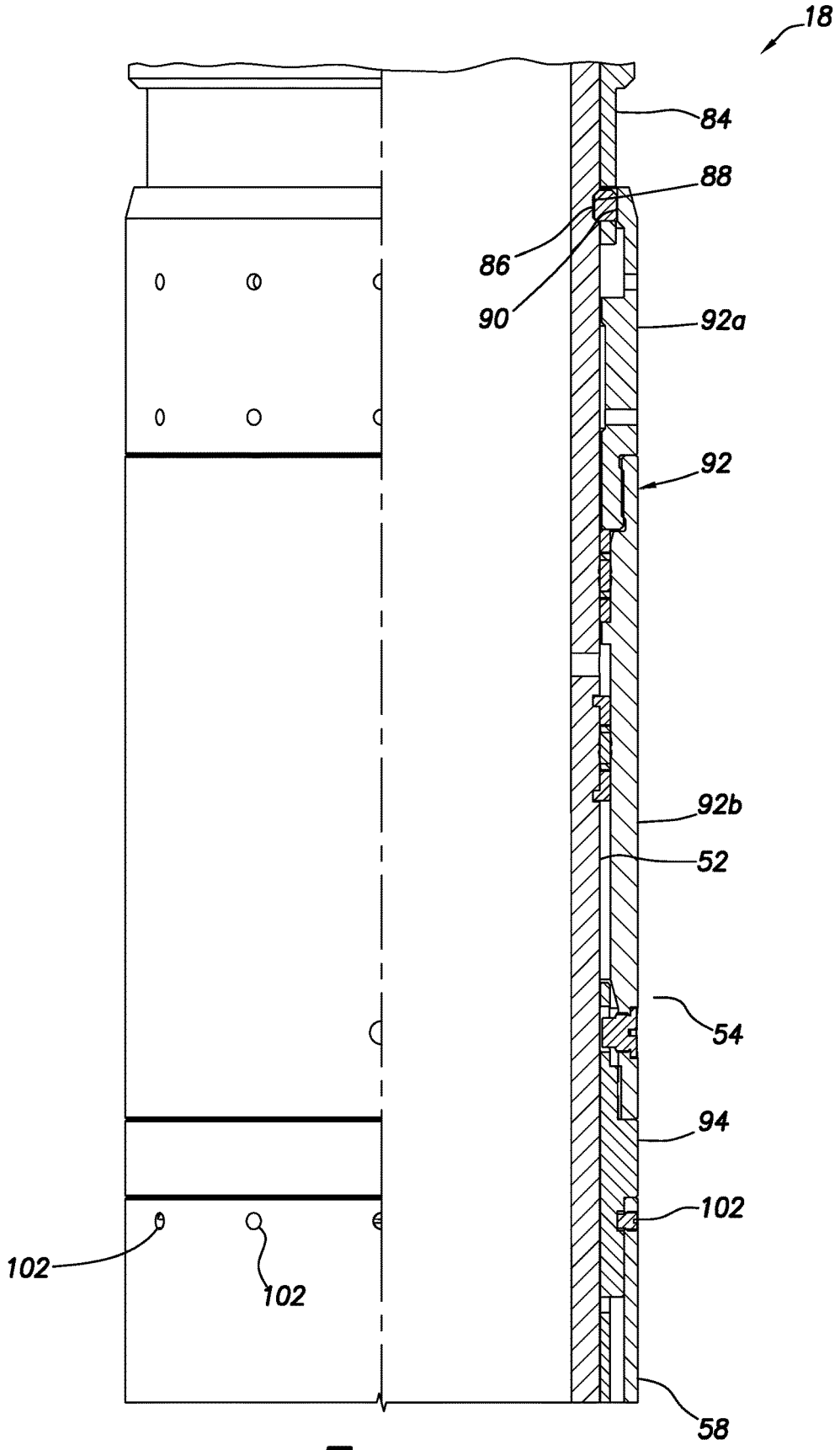
FIGS. 7A & B are representative partially cross-sectional views of another example of a liner hanger in a run-in configuration.
Figure 7B:
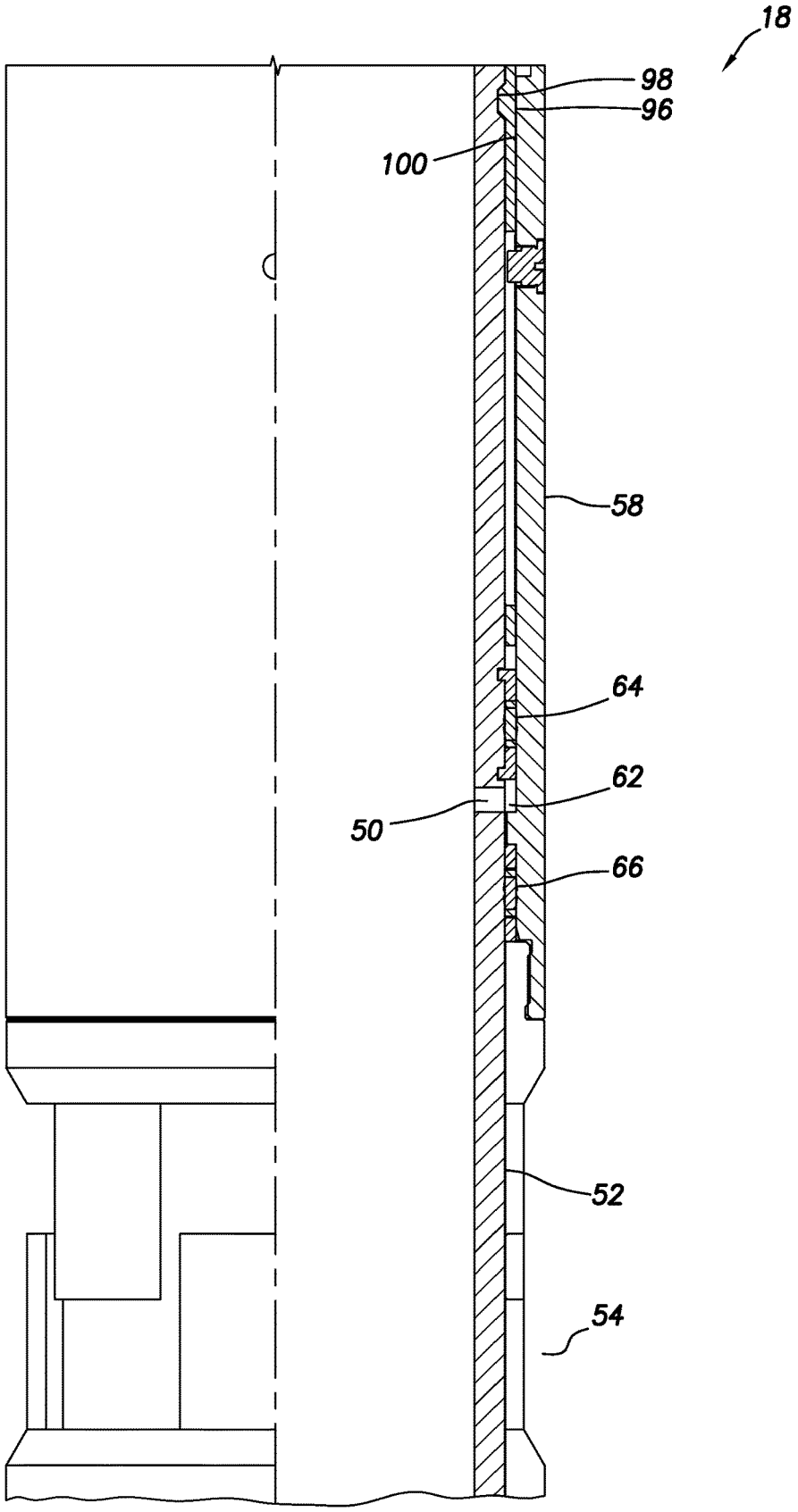

As depicted in FIGS. 7A & B, the liner hanger 18 is in a run-in configuration. Although the slips 26 are not shown in FIGS. 7A & B, they are connected to a generally tubular slip connector 84 that outwardly surrounds the mandrel 52. An upper end of the slip connector 84 is similar to the upper end of the collet sleeve 78 in the FIGS. 3A-6 example, so that the slip connector 84 displaces with the slips 26 relative to the mandrel 52.

The slip connector 84 is prevented from displacing relative to the mandrel 52 by engagement of multiple circumferentially spaced apart engagement members 86 with a profile 88 formed on the mandrel 52. The engagement members 86 are radially inwardly maintained in engagement with the profile by an interior cylindrical support surface 90 formed in an annular piston 92 that outwardly surrounds the mandrel 52. In this example, the piston 92 includes two sections—an upper section 92*a* that includes the support surface 90 and a lower section 92*b* that is secured to a collet sleeve 94.

The collet sleeve 94 includes multiple circumferentially distributed collets 96 disposed between the outer housing 58 and the mandrel 52. The collets 96 are radially inwardly maintained in engagement with a profile 98 formed on the mandrel 52 by an interior cylindrical support surface 100 formed in the outer housing 58.

The collet sleeve 94 is releasably secured to the outer housing 58 with one or more shear members 102 (such as, shear screws, shear pins, a shear ring, etc.). The shear members 102 prevent longitudinal displacement of the outer housing 58 relative to the mandrel 52, until a predetermined pressure differential is applied from the interior to the exterior of the liner hanger 18 (e.g., from an interior of the mandrel 52 to the annulus 54 surrounding the liner hanger). In this example, the pressure differential is applied by increasing the pressure applied to the port 50 using the running tool 22 as described above.

Figure 8:
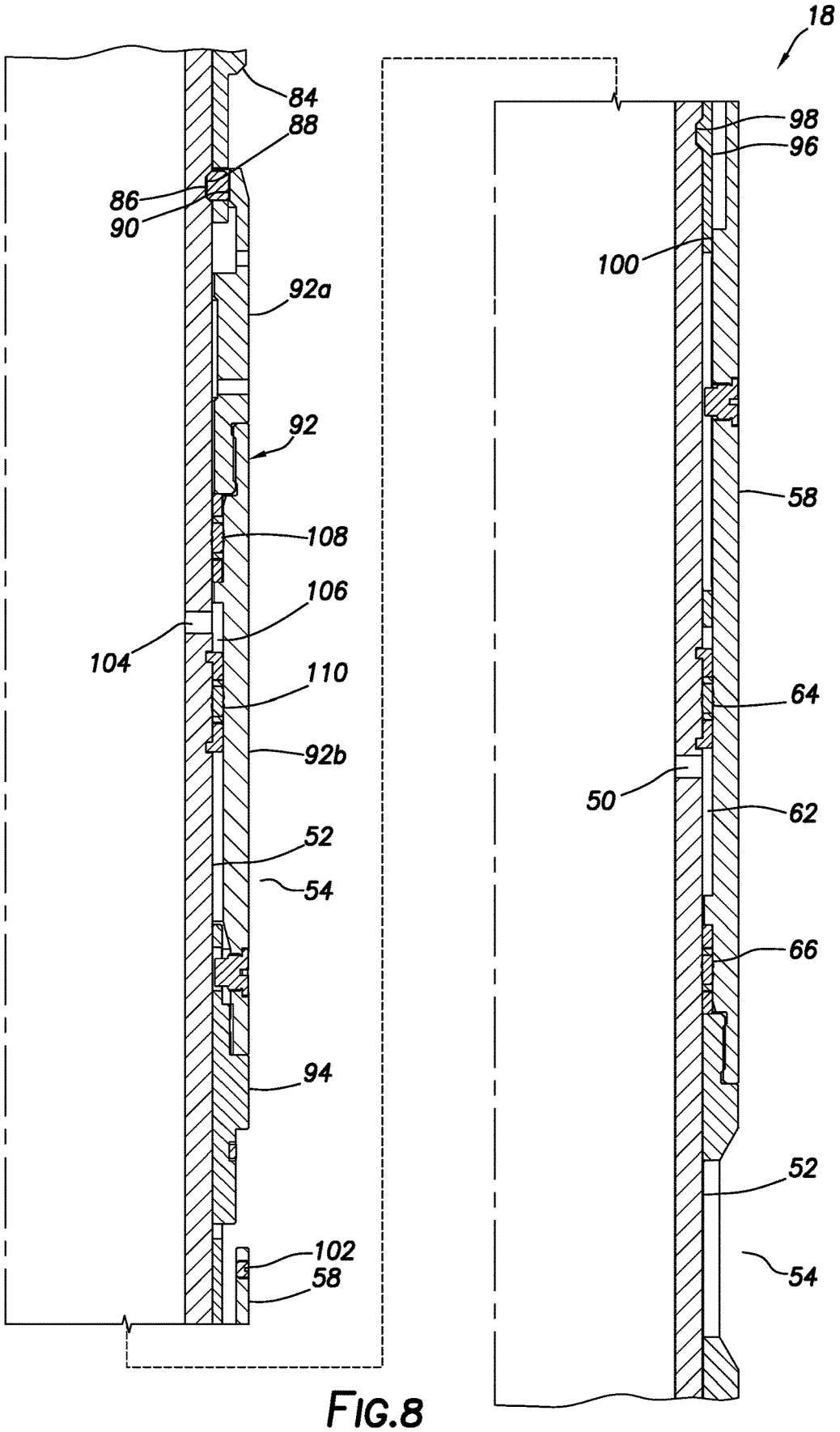
FIG. 8 is a representative cross-sectional view of the FIGS. 7A & B liner hanger in a partially set configuration.

Referring now to FIG. 8, sufficient increased pressure applied to the chamber 62 between the seals 64, 66 via the port 50 causes the shear members 102 to shear. The outer housing 58 can then displace downward due to the pressure differential from the interior to the exterior of the liner hanger 18. When the outer housing 58 displaces downward, the support surface 100 will no longer outwardly support the collets 96 in engagement with the profile 98.

Note that another port 104 is formed through the sidewall of the mandrel 52. Pressure applied to the port 50 using the running tool 22 is also applied to the port 104. The port 104 provides communication between the interior of the liner hanger 18 and an annular chamber 106 formed radially between the piston 92 and the mandrel 52, and longitudinally between seals 108, 110 that seal between the piston 92 and the mandrel 52.

Figure 9:
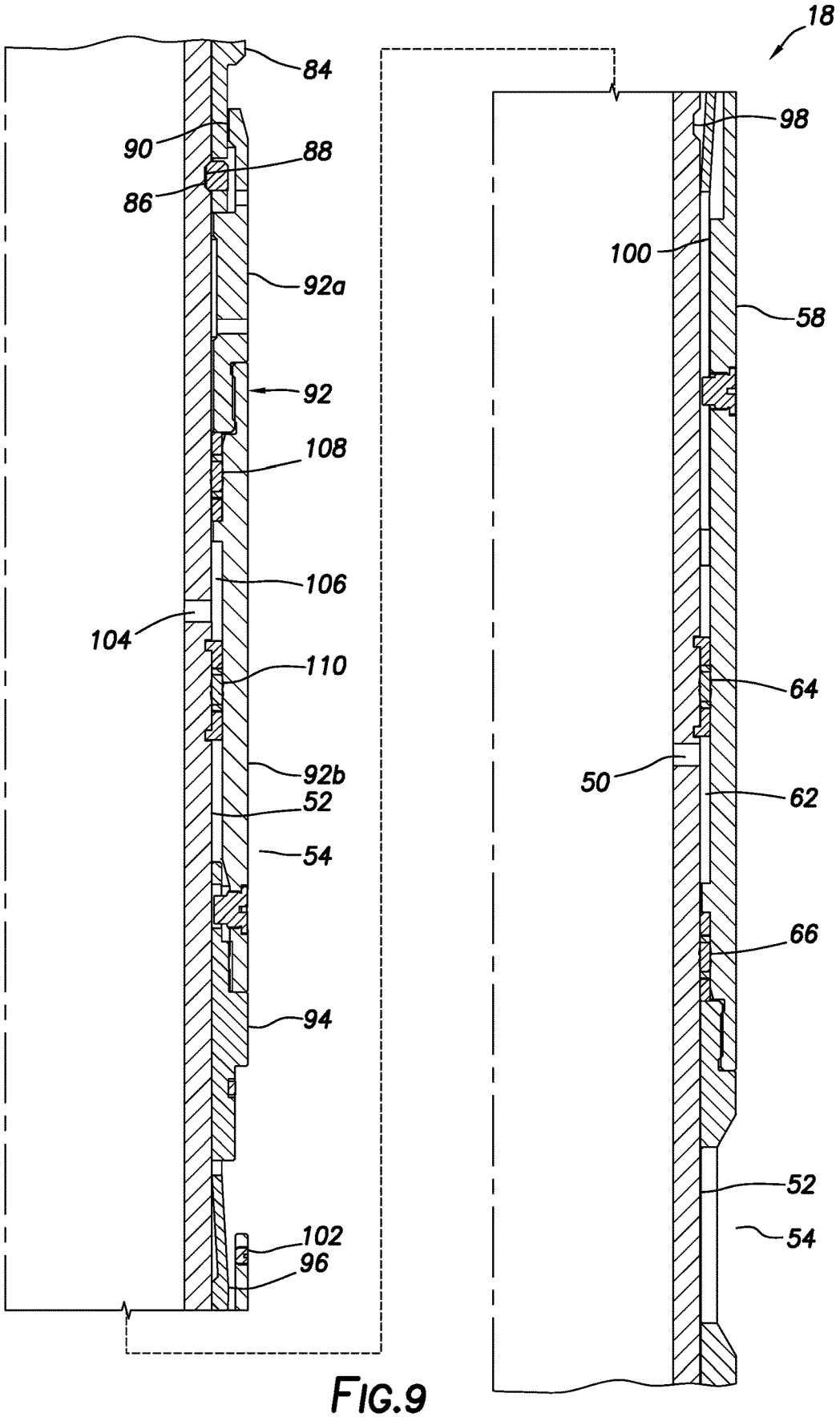
FIG. 9 is a representative cross-sectional view of the FIGS. 7A & B liner hanger in a further partially set configuration.

Referring now to FIG. 9, the increased pressure applied to the chamber 106 via the port 104 has caused the annular piston 92 to displace upward relative to the mandrel 52. The piston 92 can displace upward now due to the support surface 100 in the outer housing 58 no longer outwardly supporting the collets 96 in engagement with the profile 98 on the mandrel 52. The collets 96 are bowed radially outward when the piston 92 displaces upward.

The upward displacement of the piston 92 causes the support surface 90 to no longer outwardly support the engagement members 86 in engagement with the profile 88 on the mandrel 52. In addition, the piston 92 abuts a lower end of the slip connector 84, so that an upwardly biasing force due to the pressure differential across the piston is applied to the slip connector and, thus, to the slips 26.

Figure 10:
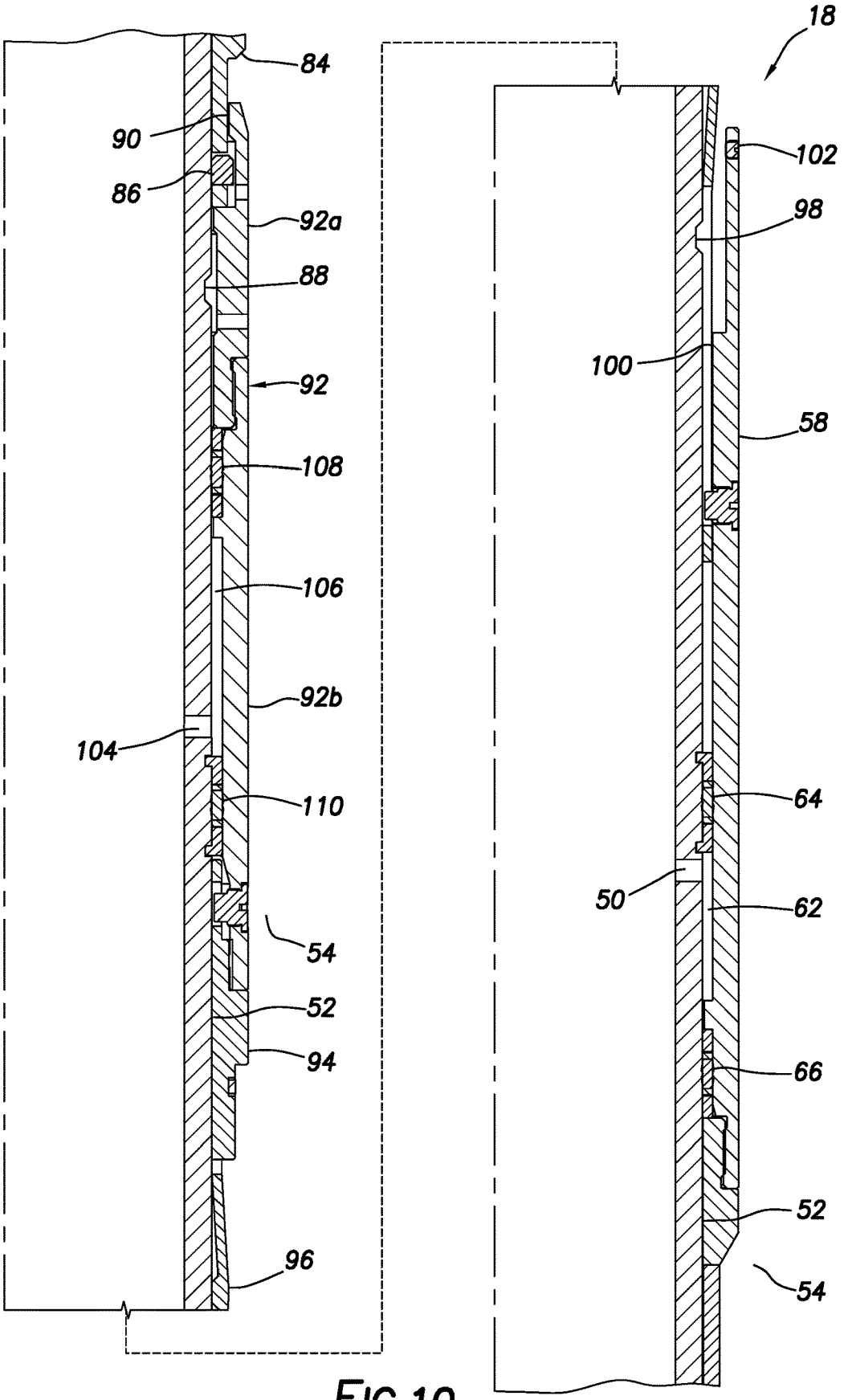
FIG. 10 is a representative cross-sectional view of the FIGS. 7A & B liner hanger in a set configuration.

Referring now to FIG. 10, the liner hanger 18 is representatively illustrated in a fully set configuration. The increased pressure applied to the chamber 106 via the port 104 has caused the piston 92 to displace fully upward, thereby also displacing the slip connector 84 and the slips 26. In this configuration, the slips 26 are outwardly deflected by the wedges 80 into gripping engagement with the interior surface 16*a* of the previous liner or casing 16 (as in the FIG. 6 example).

Note that the slips 26 and slip connector 84 cannot be displaced upward to their set position, until the piston 92 is displaced upward to no longer support the engagement members 86. The piston 92 and collet sleeve 94 cannot displace upward, until sufficient increased pressure is applied to the chamber 62 via the port 50 to shear the shear members 102, displace the outer housing 58 downward and thereby no longer support the collets 96. Thus, inadvertent premature setting of the liner hanger 18 is prevented while the liner hanger is being conveyed to its desired set location in the well.

Referring additionally now to FIGS. 11-14, another example of the liner hanger 18 is representatively illustrated. Elements of the FIGS. 11-14 liner hanger 18 that are the same as or similar to elements described above are indicated in FIGS. 11-14 using the same reference numbers.

Figure 11:
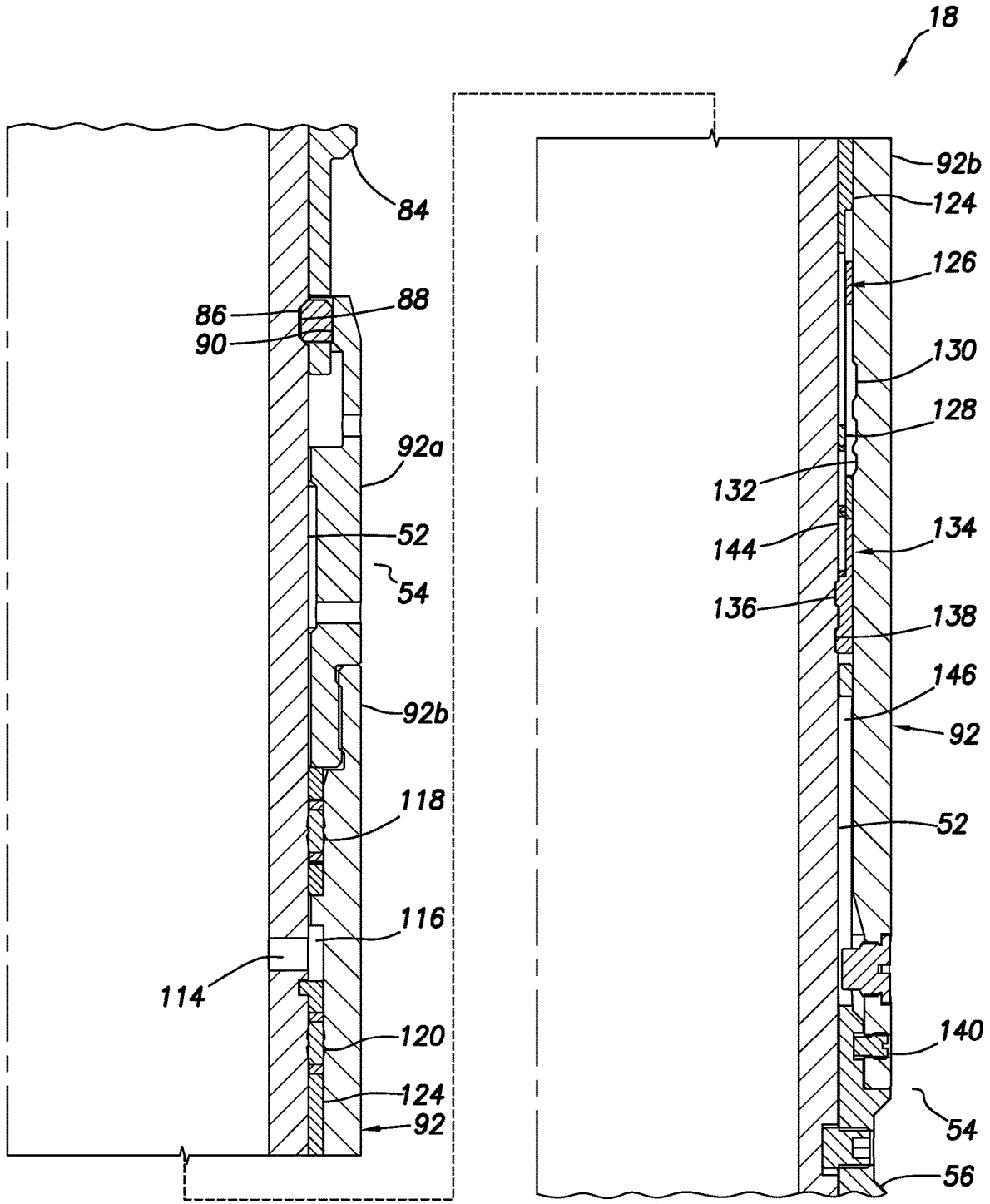
FIG. 11 is a representative partially cross-sectional view of another example of a liner hanger in a run-in configuration.

As depicted in FIG. 11, the liner hanger 18 is in a run-in configuration. The slip connector 84 and the slips 26 connected thereto are prevented from displacing longitudinally relative to the mandrel 52 by engagement of the engagement members 86 with the profile 88 on the mandrel. The support surface 90 outwardly supports the engagement members 86, so that they are prevented from displacing radially outward.

A port 114 is formed through a sidewall of the mandrel 52. The port 114 provides communication between an interior of the mandrel 52 and an annular chamber 116 formed radially between the mandrel and the piston 92, and longitudinally between seals 118, 120 that seal between the mandrel and the piston. Increased pressure can be applied to the chamber 116 via the port 114 using the running tool 22 as described above for the port 50 and chamber 62.

The seal 120 is positioned at an upper end of an annular piston 124 formed on an upper end of a tubular support sleeve 126. The piston 124 is positioned in an annulus 146 formed radially between the piston 92 and the mandrel 52.

The support sleeve 126 includes an exterior support surface 128 that inwardly supports multiple circumferentially distributed collets 130 in engagement with an internal profile 132 formed in the piston 92. One or more bias members 144 (such as, a wave spring, Belleville washers, etc.) biases the support sleeve 126 toward its FIG. 11 position in which the collets 130 are inwardly supported.

The collets 130 are formed on a collet sleeve 134 positioned between the piston 92 and the mandrel 52. The collet sleeve 134 is prevented from displacing longitudinally relative to the mandrel 52 by engagement between an internal profile 136 formed in a lower end of the collet sleeve 134 and an external profile 138 formed on the mandrel. The piston 92 is prevented from displacing longitudinally relative to the mandrel 52 by one or more shear members 140 that releasably secure the outer housing to the gauge ring 56.

Figure 12A:
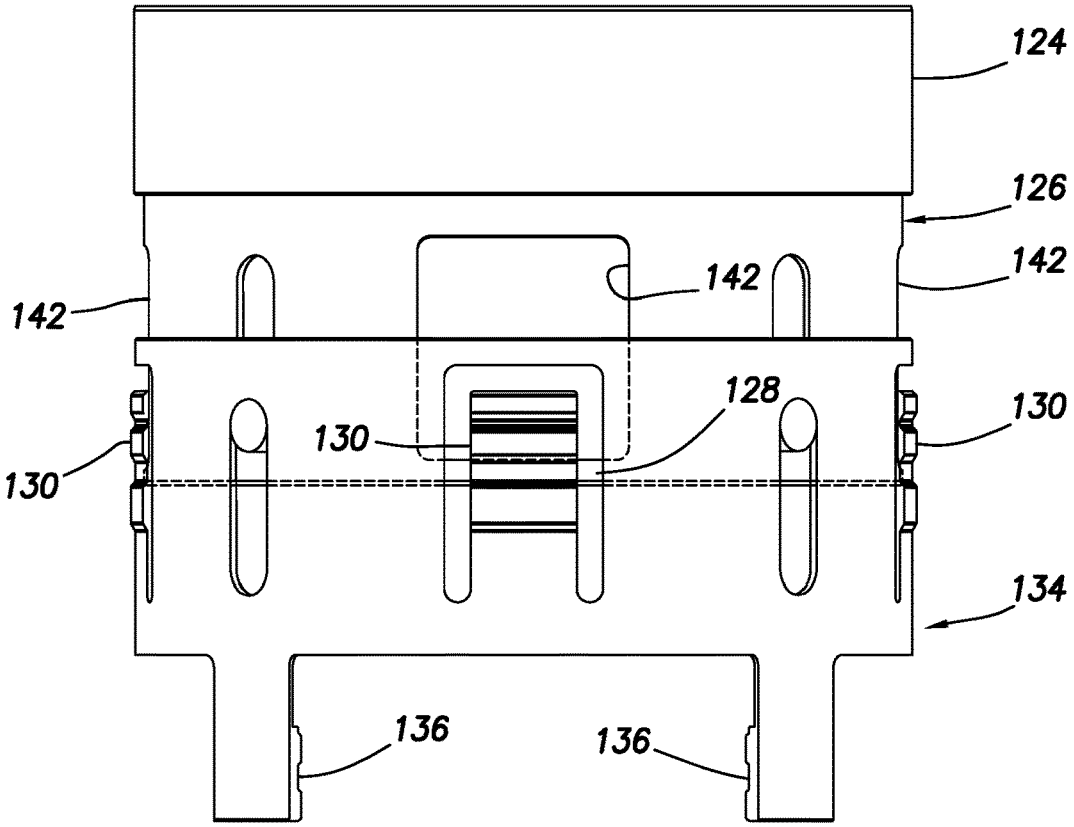
FIGS. 12A & B are representative side views of examples of a collet assembly and a collet support of the FIG. 11 liner hanger in respective supported and unsupported configurations.
Figure 12B:
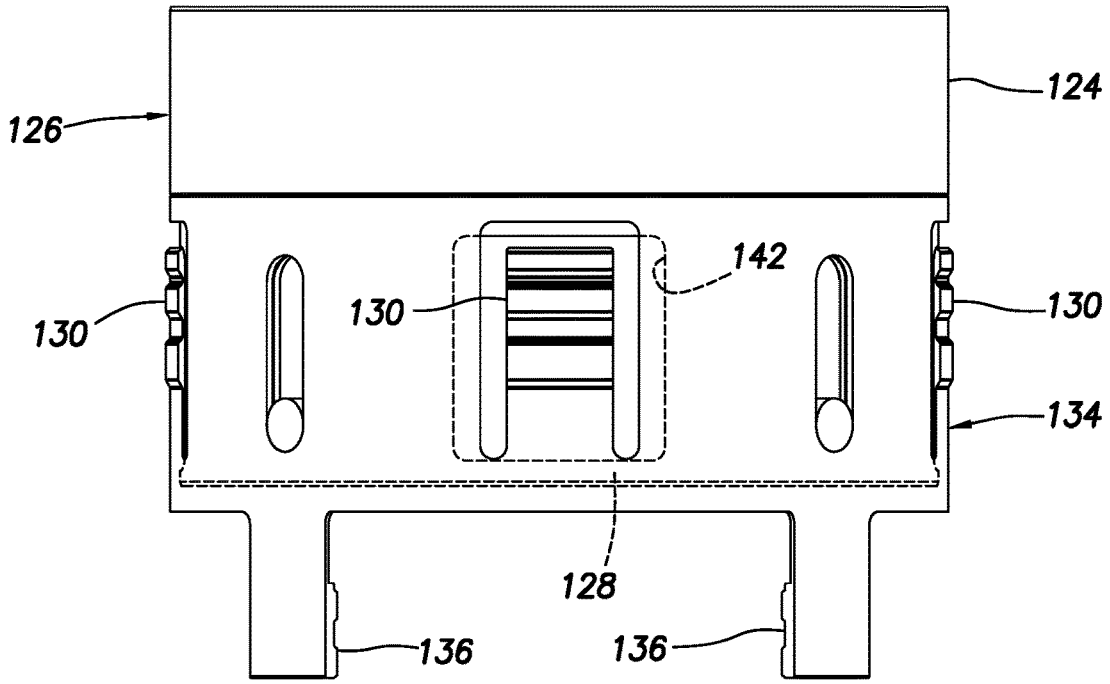

Referring now to FIGS. 12A & B, the support sleeve 126 and the collet sleeve 134 are representatively illustrated in respective supported and unsupported configurations. In FIG. 12A, the collets 130 of the collet sleeve 134 are inwardly supported by the support surface 128 of the support sleeve 126. In FIG. 12B, the collets 130 are not supported by the support surface 128, and the collets can be deflected radially inward.

The FIG. 12A supported configuration corresponds to the run-in configuration of the liner hanger 18 as depicted in FIG. 11. Note that openings 142 formed through the support sleeve 126 are each positioned partially above a respective one of the collets 130.

In the FIG. 12B unsupported configuration, the support sleeve 126 has been displaced downward relative to the collet sleeve 134, so that the support surface 128 no longer inwardly supports the collets 130. Instead, each collet 130 is positioned radially outwardly overlying a respective one of the openings 142.

Figure 13:
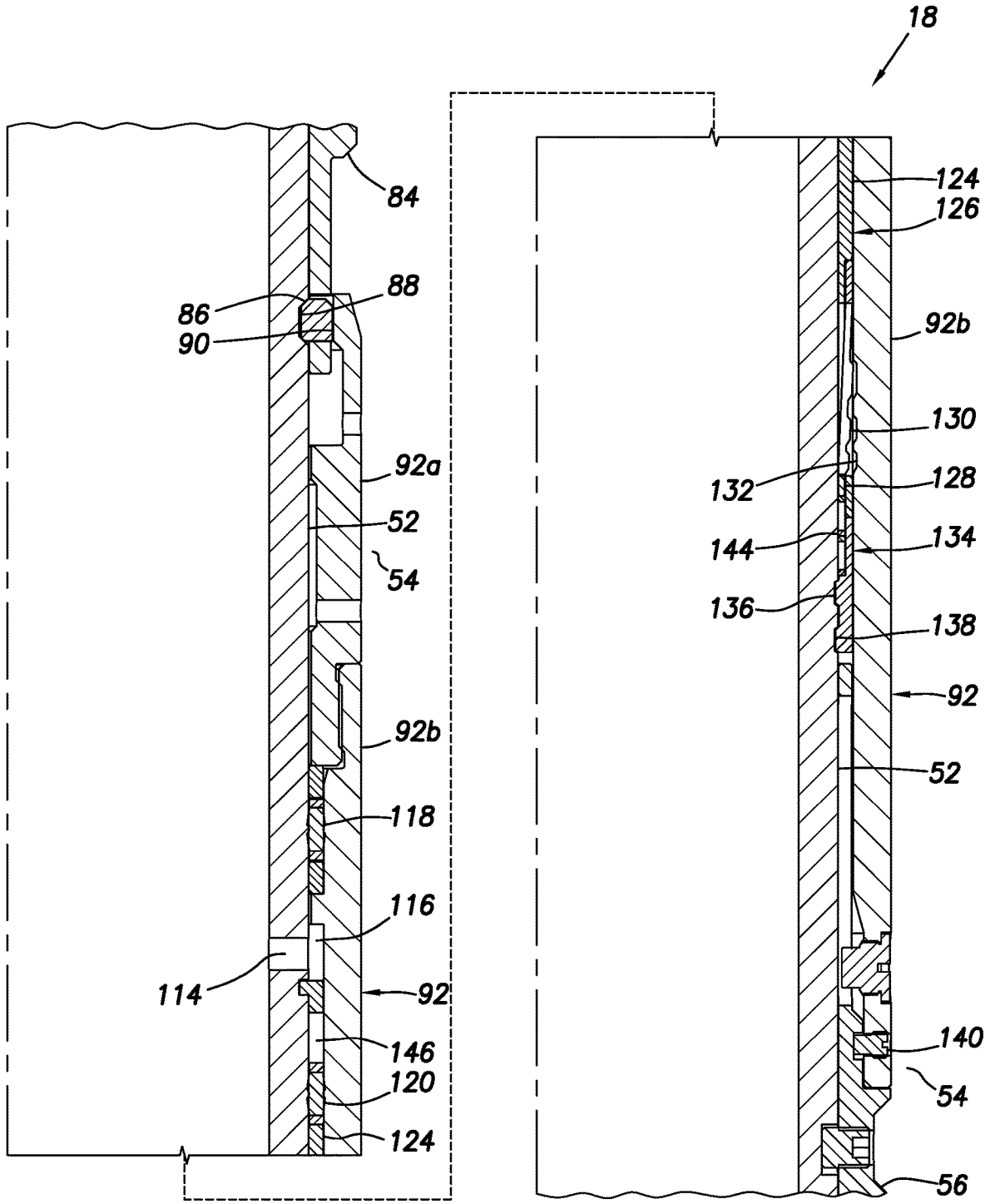
FIG. 13 is a representative cross-sectional view of the FIG. 11 liner hanger in a partially set configuration.

Referring now to FIG. 13, the liner hanger 18 is representatively illustrated after a predetermined pressure differential has been applied from an interior to an exterior of the liner hanger (e.g., from the port 114 to the annulus 54 surrounding the liner hanger) by applying increased pressure to the chamber 116 via the port 114 using the running tool 22. The pressure differential across the seal 120 causes the piston 124 and the remainder of the support sleeve 126 to displace downward to the unsupported position of FIG. 12B against the biasing force exerted by the bias member 144.

Since the support surface 128 no longer inwardly supports the collets 130, the collets are permitted to deflect radially inward and out of engagement with the profile 132. Thus, the collets 130 no longer prevent displacement of the piston 92 relative to the mandrel 52.

Figure 14:
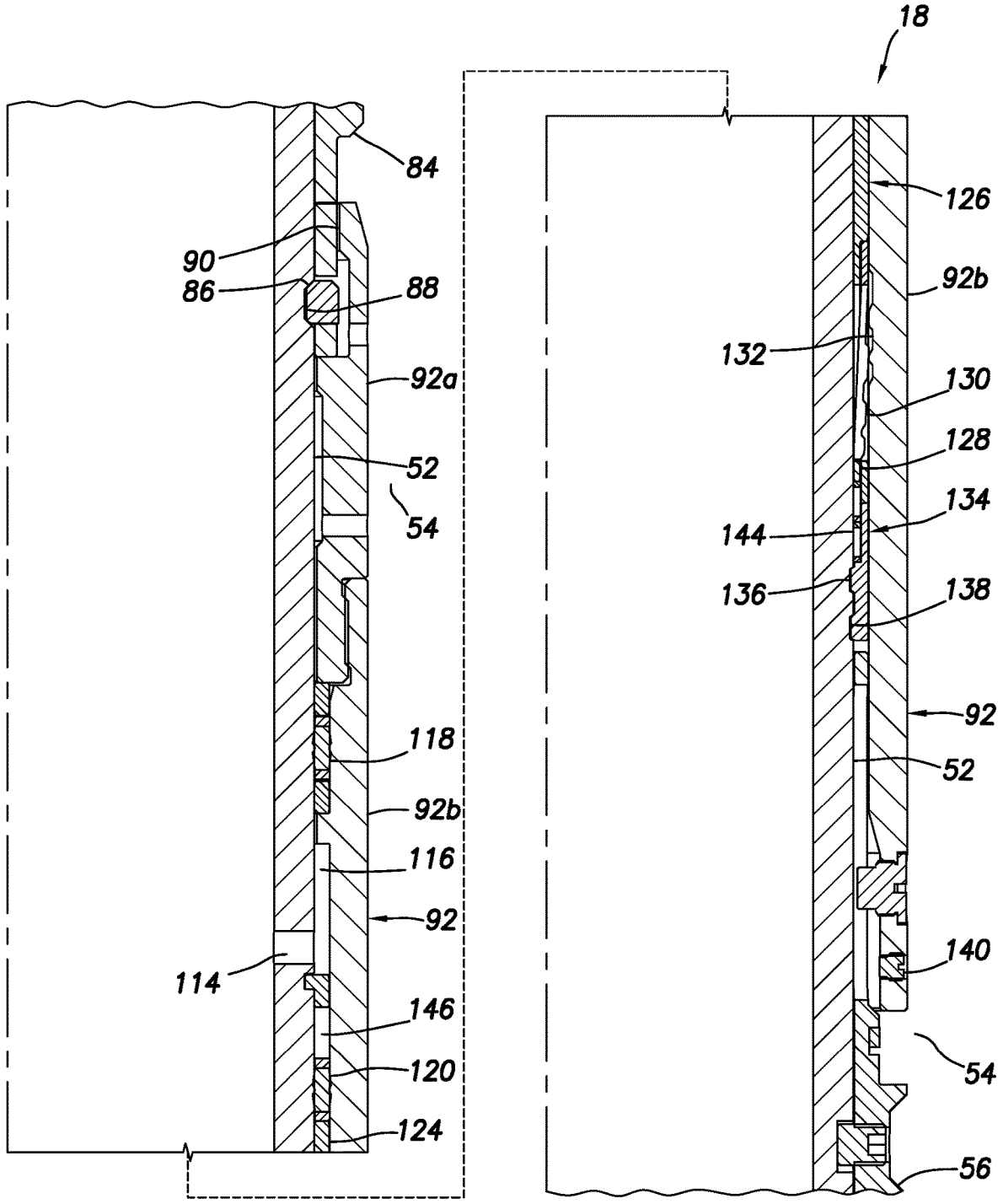
FIG. 14 is a representative cross-sectional view of the FIG. 11 liner hanger in a setting configuration.

Referring now to FIG. 14, the liner hanger 18 is depicted in a configuration in which the pressure differential applied from the interior to the exterior of the liner hanger is able to set the liner hanger. In this configuration, the increased pressure applied to the chamber 116 has caused the shear members 140 to shear, thereby permitting the piston 92 to displace upward relative to the mandrel 52, so that the upper portion 92*a* of the piston 92 now abuts a lower end of the slip connector 84.

Due to the upward displacement of the piston 92, the support surface 90 no longer outwardly supports the engagement members 86. As a result, the engagement members 86 can now displace radially outward out of engagement with the profile 88. Thus, an upward biasing force due to the pressure differential across the seal 118 will continue to displace the piston 92 upward, the engagement members 86 will be deflected radially outward out of engagement with the profile 88, and the slip connector 84 and the slips 26 will be displaced upward as described above for the FIGS. 7-10 example. The slips 26 will grippingly engage the interior surface 16*a* of the previous liner or casing 16 (see FIG. 6).

In the FIGS. 11-14 example, the piston 92 cannot be displaced upward relative to the mandrel 52, until the support sleeve 126 has been displaced downward due to the increased pressure applied to the chamber 116. The slip connector 84 cannot be displaced upward to set the slips 26, until the piston 92 is displaced upward due to the pressure differential applied from the interior to the exterior of the liner hanger 18. Thus, inadvertent premature setting of the liner hanger 18 is prevented while the liner hanger is being conveyed to its desired set location in the well.

It may now be fully appreciated that the above disclosure provides significant advancements to the art of designing, constructing and operating liner hangers for use in subterranean wells. In examples described above, the liner hanger 18 cannot be set until a predetermined pressure differential is applied from an interior to an exterior of the liner hanger.

The above disclosure provides to the art a liner hanger 18 for use in a subterranean well. In one example, the liner hanger 18 can comprise: slips 26 configured to anchor the liner hanger 18 in the well; a tubular mandrel 52; a tubular outer housing 58 outwardly surrounding the mandrel 52, the outer housing 58 being rigidly secured to the mandrel 52; a collet sleeve 78 disposed on the mandrel 52 and including multiple collets 74, the collet sleeve 78 being connected to the slips 26; and an annular piston 68 disposed in an annulus 60 formed radially between the mandrel 52 and the outer housing 58, the piston 60 including a support surface 72 configured to support the collets 74 and thereby prevent displacement of the slips 26 relative to the mandrel 52.

The piston 68 may support the collets 74 in engagement with a profile 76 formed in the outer housing 58.

A port 50 may be formed through a sidewall of the mandrel 52. A shear member 70 may releasably secure the piston 68 against displacement relative to the mandrel 52 in response to pressure applied to the port 50. The piston 68 may be configured to displace relative to the mandrel 52 in response to a predetermined pressure applied to the port 50 to thereby no longer support the collets 74.

The piston 68 may be configured to displace the collet sleeve 78 and the slips 26 relative to the mandrel 52 after the collets 74 are no longer supported by the piston 68. The collets 74 may be configured to prevent displacement of the piston 68 relative to the mandrel 52 after the piston 68 has displaced the collet sleeve 78 and the slips 26 relative to the mandrel 52.

Also provided to the art by the above disclosure is another liner hanger 18 for use in a subterranean well. In this example, the liner hanger 18 can comprise: slips 26 configured to anchor the liner hanger 18 in the well; a tubular mandrel 52; a tubular outer housing 58 outwardly surrounding the mandrel 52; a collet sleeve 94 disposed on the mandrel 52 and including multiple collets 96, the collets 96 being supported by the outer housing 58; and an annular piston 92 outwardly surrounding the mandrel 52, the piston 92 including a support surface 90 configured to support at least one engagement member 86 and thereby prevent displacement of the slips 26 relative to the mandrel 52.

The collets 96 may be engaged with a profile 98 formed on the mandrel 52. The outer housing 58 may be releasably secured to the collet sleeve 94 by at least one shear member 102.

The support surface 90 may be configured to support the at least one engagement member 86 in engagement with a profile 88 formed on the mandrel 52.

The outer housing 58 may be configured to displace in a first longitudinal direction (e.g., in a downhole or downward direction) relative to the mandrel 52 in response to application of a predetermined pressure differential from an interior to an exterior of the liner hanger 18. The piston 92 may be configured to displace in a second longitudinal direction (e.g., in an uphole or upward direction) relative to the mandrel 52 in response to the application of the predetermined pressure differential, with the second longitudinal direction being opposite to the first longitudinal direction.

The collets 96 may be configured to disengage from a profile 98 on the mandrel 52 in response to displacement of the outer housing 58 in the first longitudinal direction. The piston 92 may be configured to apply a longitudinal force to the slips 26 in response to the application of the predetermined pressure differential.

Another liner hanger 18 for use in a subterranean well can comprise: slips 26 configured to anchor the liner hanger 18 in the well; a tubular mandrel 52; a first annular piston 92 outwardly surrounding the mandrel 52, the first annular piston 92 being releasably secured against longitudinal displacement relative to the mandrel 52; a collet sleeve 134 disposed on the mandrel 52 and including multiple collets 130, the collet sleeve 134 being secured against longitudinal displacement relative to the mandrel 52; and a support sleeve 126 outwardly surrounding the mandrel 52, the support sleeve 126 including a first support surface 128 configured to support the collets 130 in engagement with a profile 132 formed in the first annular piston 92 and thereby prevent displacement of the slips 26 relative to the mandrel 52.

The first annular piston 92 may comprise a second support surface 90 configured to support at least one engagement member 86.

The liner hanger 18 may include a bias member 144 which applies a biasing force to the support sleeve 126, the biasing force biasing the support sleeve 126 toward a locked position in which the support sleeve 126 prevents disengagement of the collets 130 from the profile 132.

The liner hanger 18 may include a second annular piston 124 disposed in an annulus 146 formed radially between the piston 92 and the mandrel 52. The second annular piston 124 may be configured to displace the support sleeve 126 to an unlocked position in response to a pressure differential applied from an interior to an exterior of the liner hanger 18. The collets 130 are permitted to disengage from the first profile 132 in the unlocked position.

The liner hanger 18 may include a shear member 140 that releasably secures the piston 92 relative to the mandrel 52. The piston 92 may be configured to displace relative to the mandrel 52 to a position in which the engagement member 86 is permitted to disengage from the second profile 88 after the collets 130 are permitted to disengage from the first profile 132.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A liner hanger for use in a subterranean well, the liner hanger comprising:

slips configured to anchor the liner hanger in the well;

a tubular mandrel;

a tubular outer housing outwardly surrounding the mandrel, in which the outer housing is secured to the mandrel, and the outer housing is configured to remain stationary relative to the mandrel during setting of the liner hanger;

a collet sleeve disposed on the mandrel and including multiple collets, the collet sleeve being connected to the slips; and an annular piston disposed in an annulus formed radially between the mandrel and the outer housing, the piston including a support surface configured to support the collets and thereby prevent displacement of the slips relative to the mandrel.

2. The liner hanger of claim 1, in which the piston supports the collets in engagement with a profile formed in the outer housing.

3. The liner hanger of claim 1, in which a port is formed through a sidewall of the mandrel.

4. The liner hanger of claim 3, in which a shear member releasably secures the piston against displacement relative to the mandrel in response to pressure applied to the port.

5. The liner hanger of claim 3, in which the piston is configured to displace relative to the mandrel in response to a predetermined pressure applied to the port to thereby no longer support the collets.

6. The liner hanger of claim 5, in which the piston is configured to displace the collet sleeve and the slips relative to the mandrel after the collets are no longer supported by the piston.

7. The liner hanger of claim 6, in which the collets are configured to prevent displacement of the piston relative to the mandrel after the piston has displaced the collet sleeve and the slips relative to the mandrel.

* * * * *